US007386896B2

(12) United States Patent
Spicer

(10) Patent No.: US 7,386,896 B2
(45) Date of Patent: Jun. 17, 2008

(54) ACCESSORY DEVICE FOR SPA

(76) Inventor: Wade Spicer, R.R. 1 Route 11, Box 108, Northumberland, PA (US) 17857-0108

( * ) Notice: Subject to any disclaimer, the term of this patent is extended or adjusted under 35 U.S.C. 154(b) by 16 days.

(21) Appl. No.: 11/487,089

(22) Filed: Jul. 14, 2006

(65) Prior Publication Data

US 2006/0265802 A1 Nov. 30, 2006

Related U.S. Application Data

(63) Continuation of application No. 10/799,015, filed on Mar. 11, 2004, now abandoned.

(51) Int. Cl.
*A47K 3/00* (2006.01)

(52) U.S. Cl. ..... 4/559; 4/496; 220/23.4; 220/481

(58) Field of Classification Search ..... 4/496, 4/541.1, 553, 554, 559, 571.1, 572.1, 573.1, 4/578.1, 579, 639–642, 654, 656, 659; 220/23.4, 220/481, 482, 751; 224/544, 556, 560
See application file for complete search history.

(56) References Cited

U.S. PATENT DOCUMENTS

D261,028 S * 9/1981 Bitvai ..... 4/572.1 X
5,279,007 A 1/1994 Kolada ..... 4/656 X
5,333,322 A 8/1994 Weir ..... 4/496
6,474,244 B1 11/2002 Karpinski ..... 108/42

OTHER PUBLICATIONS

Foxxx Spas, Simply Heavenly, The Finest in Comfort, Relaxation and Hot Water Luxury Pamphlet, 8 pgs.
Emerald Spas, 2003 model year pamphlet, 35 pgs.

* cited by examiner

*Primary Examiner*—Robert M Fetsuga
(74) *Attorney, Agent, or Firm*—Thomas R. Shaffer

(57) ABSTRACT

An accessory device for a spa has a top surface and a side wall. The spa includes an upper surface portion having an inner edge and outer edge. The upper surface portion is adapted to extend outwardly from an exterior perimeter of an top surface of a spa when positioned thereon. A least one flange portion extends inwardly from said inner edge of the upper surface. The flange member is adapted to be removably attached to the top surface of the spa. At least one support portion extends downwardly from the upper surface portion and has an inner wall and an outer wall. The inner wall is adapted to rest upon and be supported by a side wall of said spa when positioned thereon. The upper surface may function as a tray for holding objects in a location accessible to persons in the spa or may have a cavity formed therein which forms a bucket for holding objects in a location accessible to persons in the spa.

14 Claims, 9 Drawing Sheets

ACCESSORY DEVICE FOR SPA

This is a continuation of U.S. patent application Ser. No. 10/799,015 filed Mar. 11, 2004, now abandoned.

BACKGROUND OF THE INVENTION

1. Field of the Invention

The present invention relates to an accessory device for a spa. More specifically, the present invention relates to an accessory device for a spa in the form of one of a tray and an ice bucket.

2. Prior Art

Hot tubs and spas are well known in the art. Typically, spas are generally cylindrical in shape and typically sit directly on the ground. The top surface of the hot tub is generally quite narrow and provides little space for storing of objects such as glasses, beverages and the like. Further, some existing hot tub manufacturers have built in cup holders but such cup holders are generally not effective in keeping beverages cold.

There remains a need, therefore, to provide additional storage around the perimeter of the spa to allow persons within the spa to have access to personal items and drinks.

SUMMARY OF THE INVENTION

The present invention provides an accessory device for a spa having a top surface and a side wall comprising:

an upper surface portion having an inner edge and outer edge, said upper surface portion adapted to extend outwardly from an exterior perimeter of a top surface of a spa when positioned thereon;

at least one flange portion extended inwardly from said inner edge of said upper surface, said flange portion adapted to be removably attached to the top surface of the spa;

at least one support portion extending downwardly from said upper surface portion and having an inner wall and an outer wall, said inner wall adapted to rest upon and be supported by a side wall of said spa when positioned thereon.

In one embodiment, said upper surface portion functions as a tray for holding objects in a location accessible to persons in the spa. In another embodiment, said upper surface portion has a cavity formed therein, said cavity functioning as a bucket for holding objects in a location accessible to persons in the spa.

Preferably, said inner edge of said upper surface is curved along an arcuate path and is adapted to mate with and conform with the curvature of the exterior perimeter of the top surface of the spa. Said outer edge of said upper surface is also preferably curved.

Preferably, said at least one flange portion is generally rectangular in shape and said opening in said at least one flange portion is also generally rectangular in shape but preferably has rounded corners. Likewise said projection member is generally rectangular in shape.

In one embodiment of the invention, a pair of spaced apart flange members are provided.

In one embodiment of the invention a pair of spaced apart support portions are provided.

Preferably, said flange portion has an opening therein adapted to receive a projection member extending upward from said top surface of said spa. Further, it is also preferred that said at least one flange portion is adapted to be received in a recess in the top surface of the spa and said flange portion has an opening therein adapted to receive a projection member extending upward from a center portion of said recess.

DETAILED DESCRIPTION OF THE PREFERRED EMBODIMENTS

Figure 1:
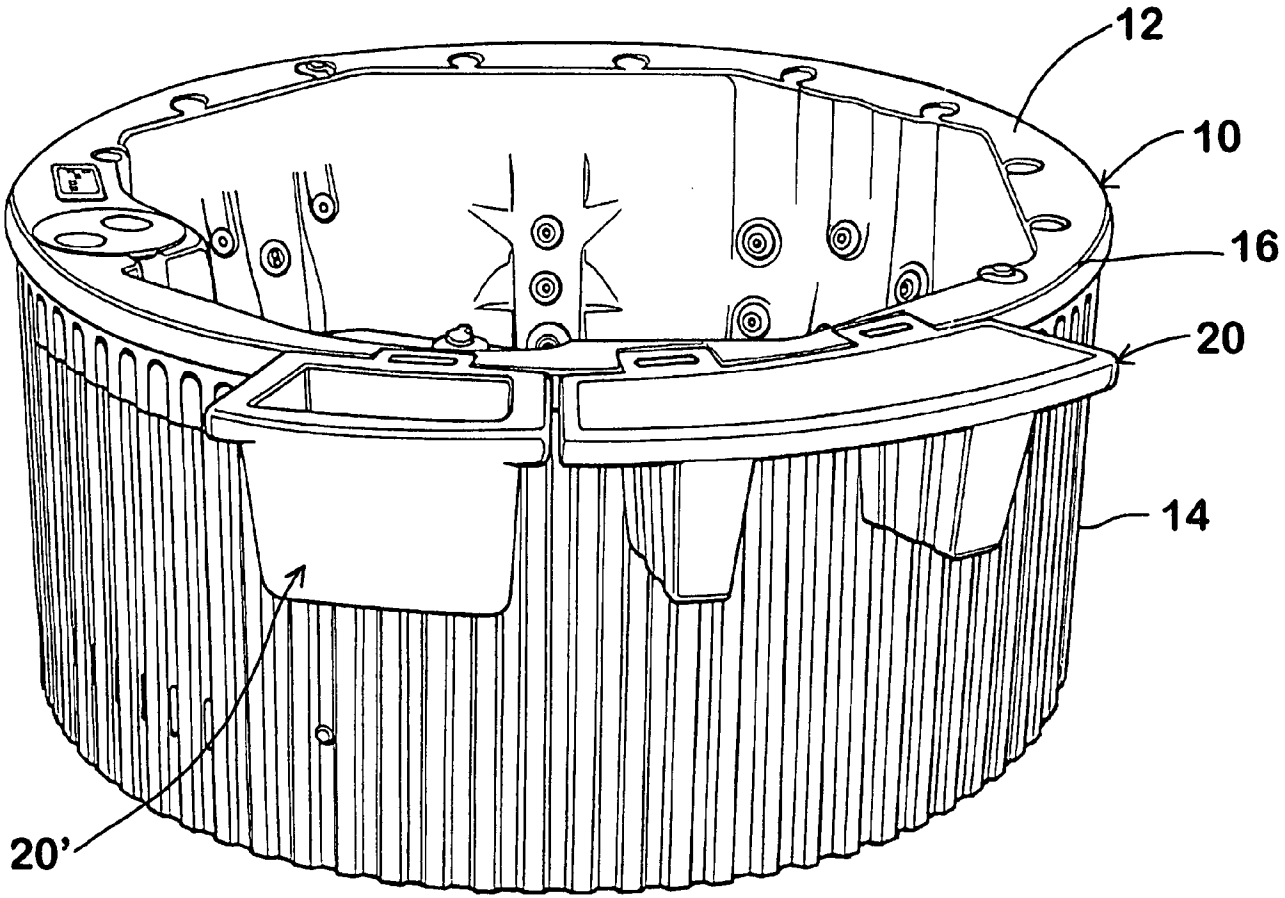
FIG. 1 is a perspective view of a spa on which two accessory devices according to the present invention are removably attached.

Referring first to FIG. 1, a spa 10 is shown which has a top surface 12, a side wall 14 and an outer perimeter 16 of the outer most edge of the top surface 12. FIG. 1 shows an accessory device 20 in the form of a tray and an accessory device 20' in the form of an ice bucket as attached to the spa 10.

Figure 2:
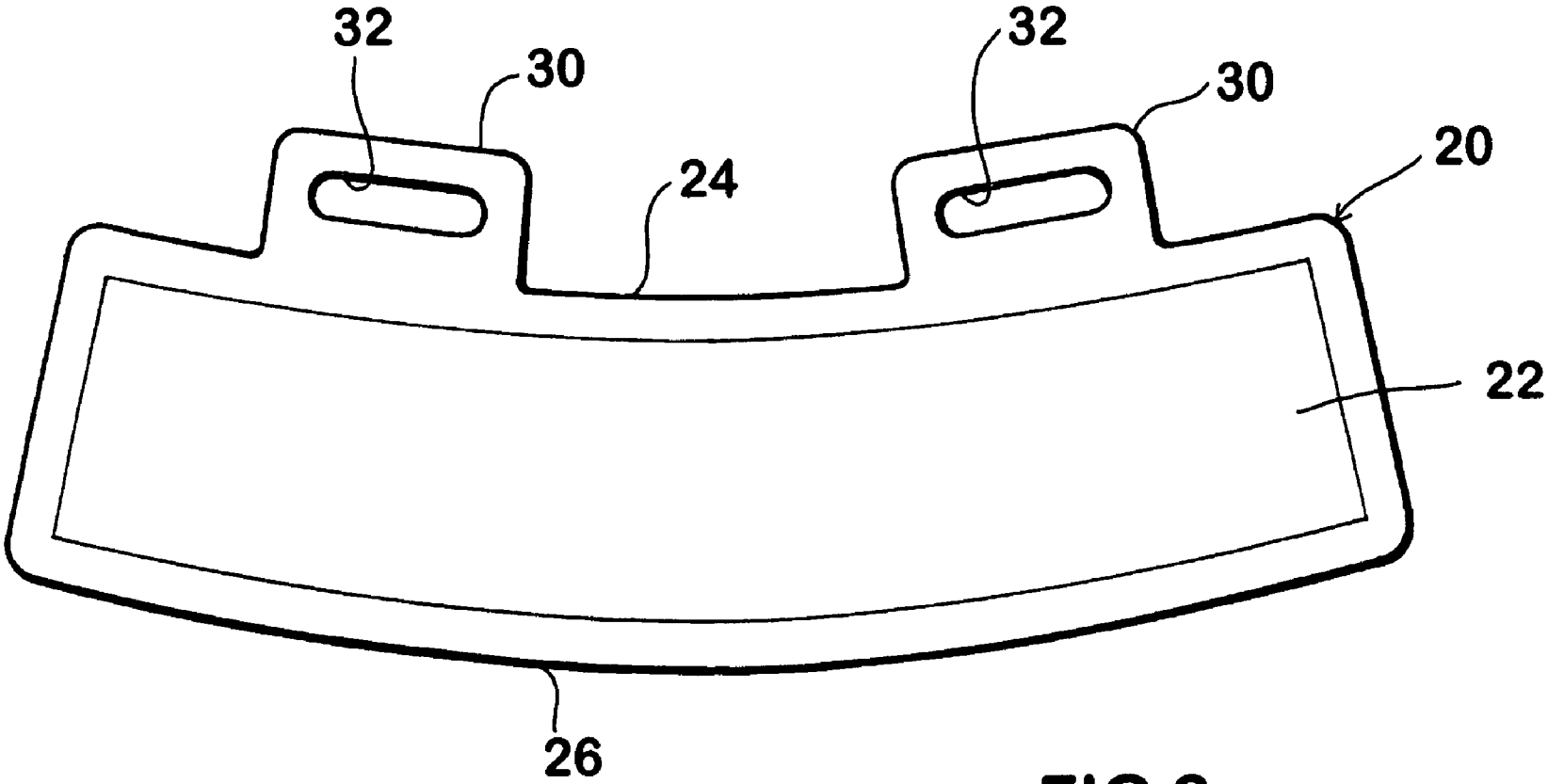
FIG. 2 is a top view of an accessory device in the form of a tray.
Figure 3:
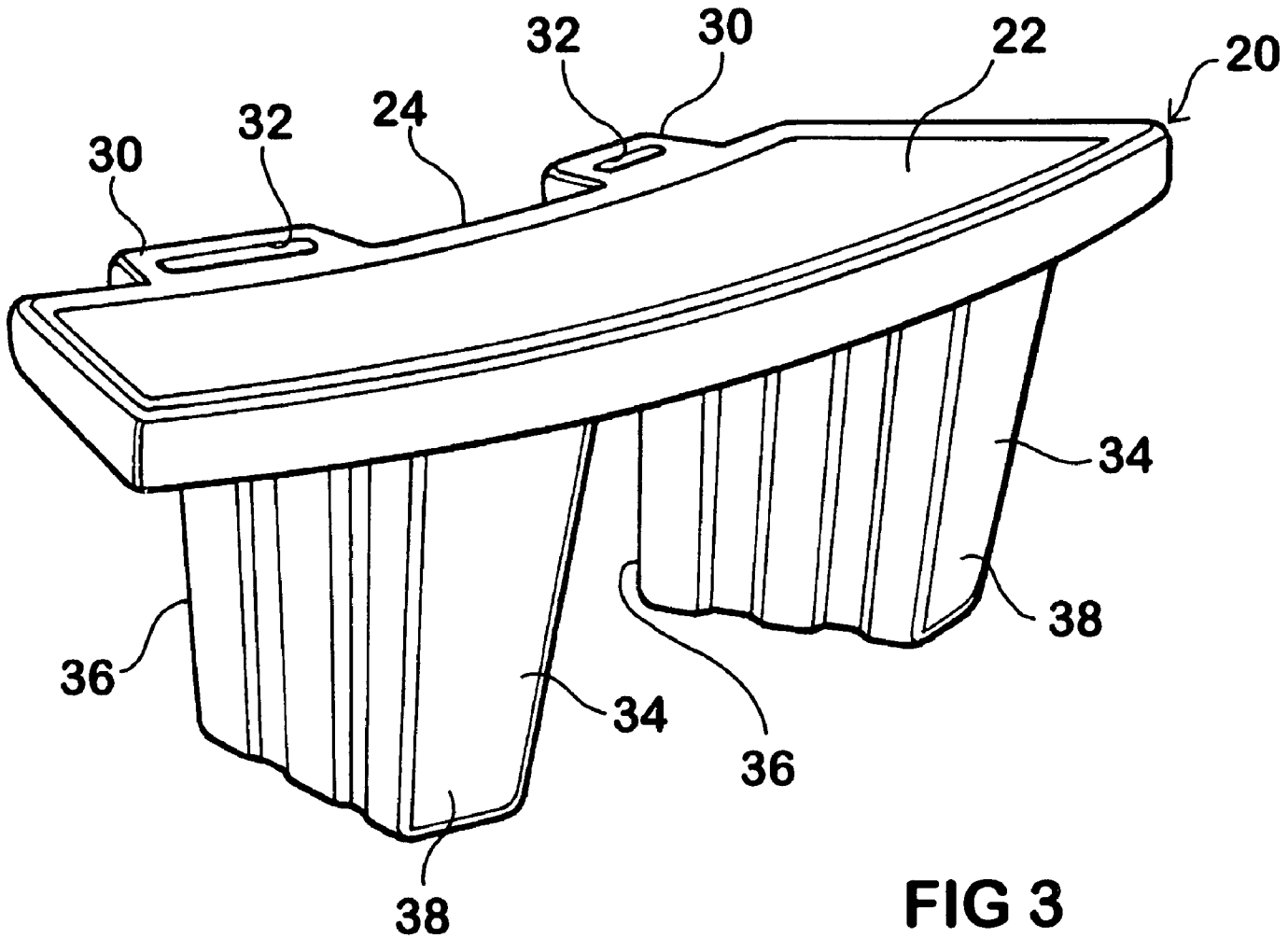
FIG. 3 is a perspective view of the accessory device in the form of a tray shown in FIG. 2.
Figure 6:
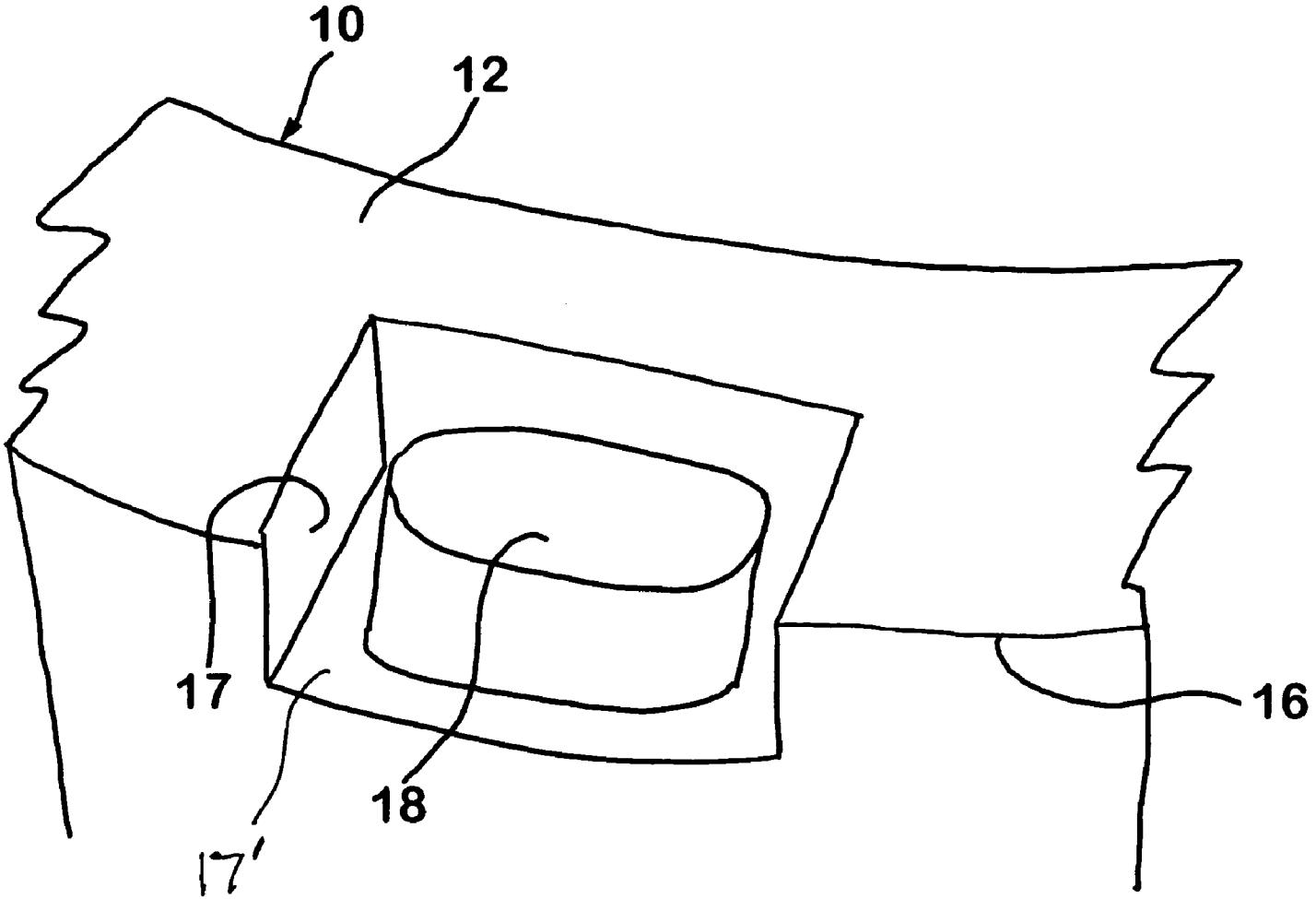
FIG. 6 is a perspective view of the top of the spa showing a recess and projection utilized to secure the accessory device of the present invention.
Figure 7:
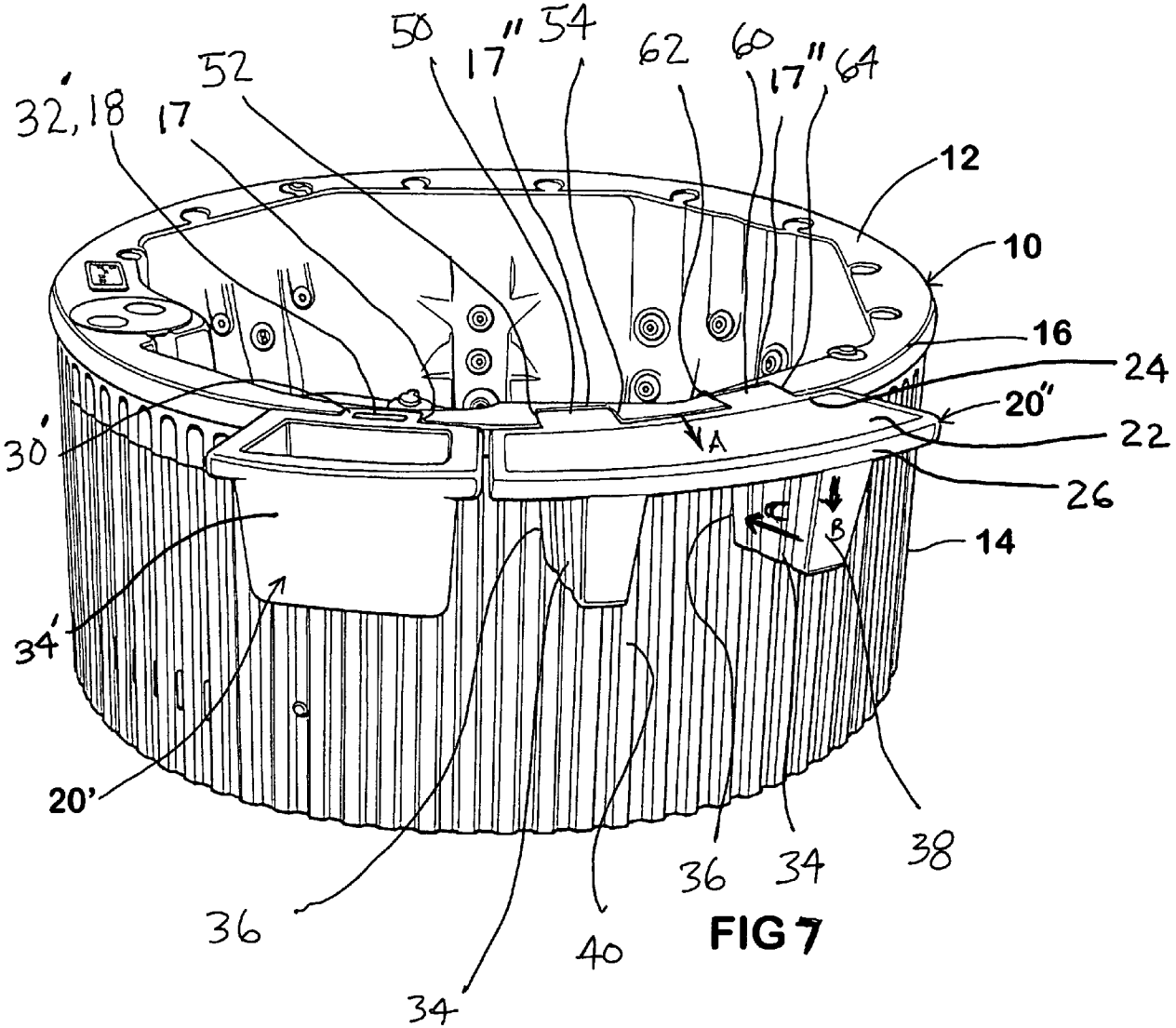
FIG. 7 is a perspective view of the spa of FIG. 1 with an accessory device 20" shown which has flanges 50 and 60 without openings.
Figure 8:
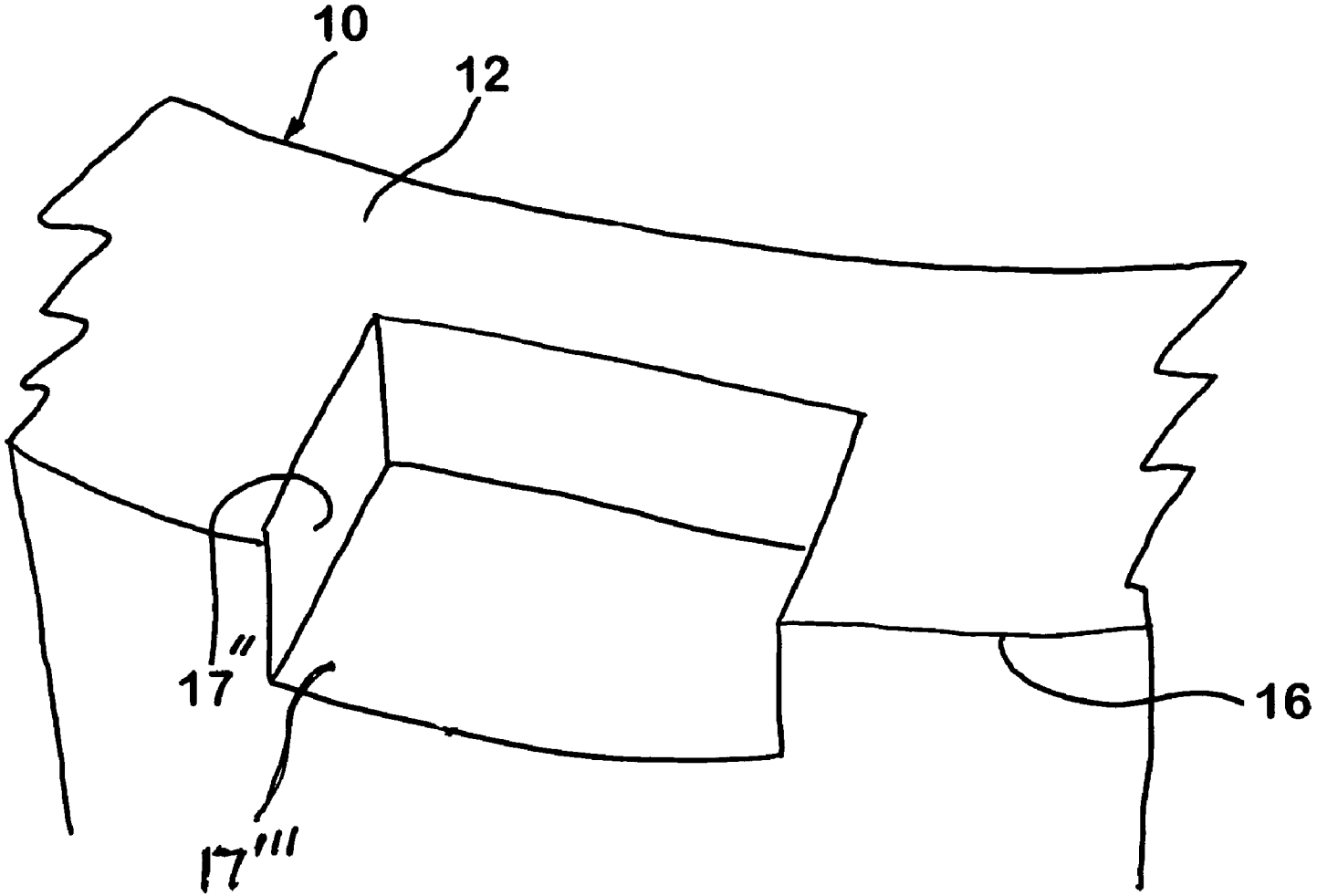
FIG. 8 is a perspective view of the top of the spa of FIG. 6 with no projection.
Figure 9:
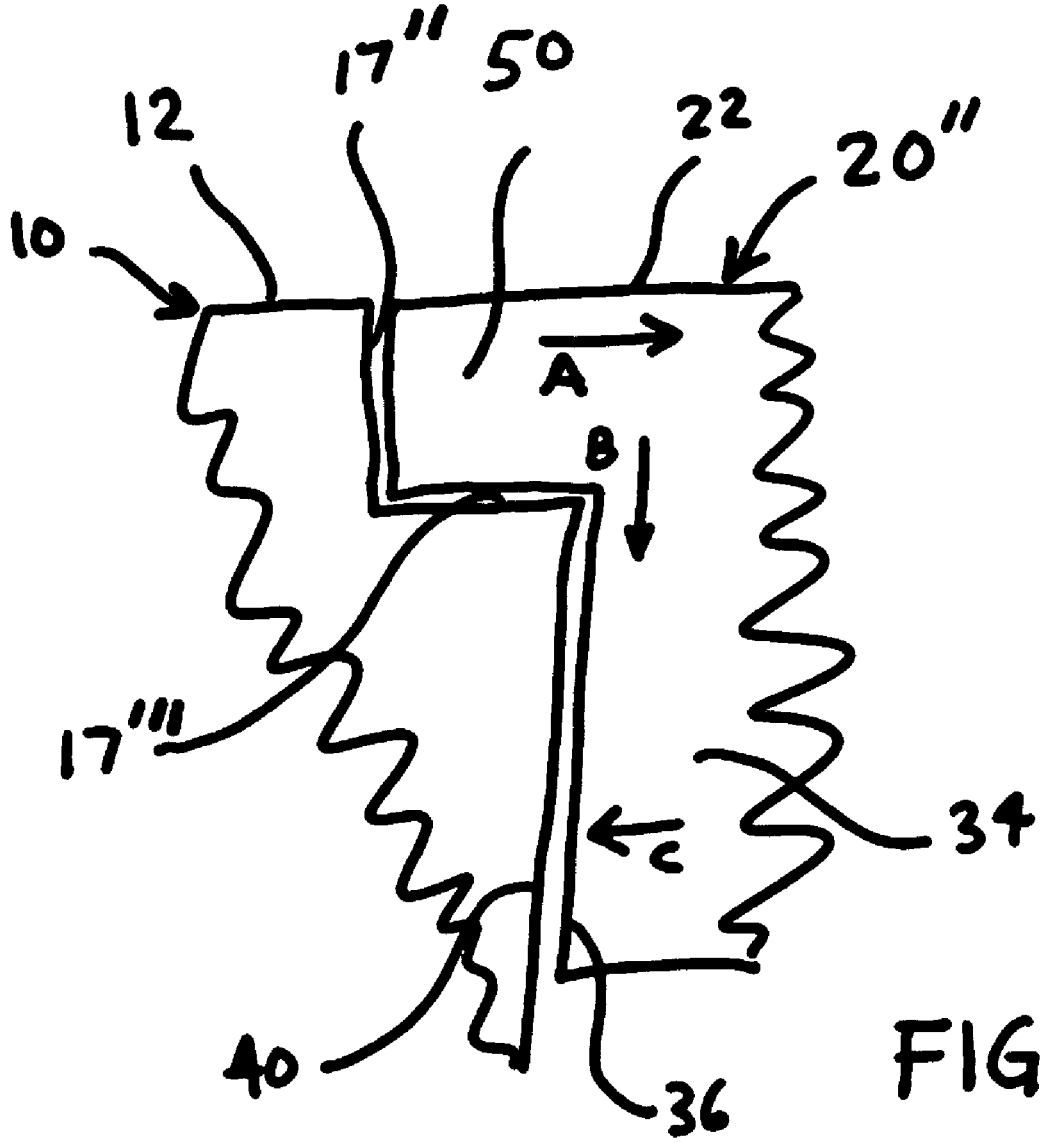
FIG. 9 is a cross sectional view showing a flange supported in a recess in the top surface of a spa.

Referring to FIGS. 2 and 3, the accessory device 20 in the form of a tray has an upper surface 22 which includes an inner perimeter edge 24 and an outer perimeter edge 26. The accessory device 20 is formed of a plastic material. At least one flange portion such as flanges 30 shown in FIG. 3 extend inwardly from and along a portion of the inner perimeter edge of the upper surface 22. Said flanges 30 are formed of a particular shape and are shown as being generally rectangular in shape. Flanges 30 are received by a recess 17 of a particular shape (rectangular shape shown) which forms a notch in the perimeter 16 of the top surface 12 of spa 10 (see FIG. 6). When so received, said upper surface 22 of the accessory device is coplanar with the top surface 12 of the spa. Openings 32 which are also generally rectangular in shape are provided in a center portion of the flange 30. The accessory device 20 includes downwardly depending support portions 34 which each have an inner wall 36 and an outer wall 38. FIGS. 2 and 3 show an accessory device in the form of a tray. The accessory device 20 has an inner edge 24 of the upper surface 22 which is curved along an arcuate path and is juxtaposed and adapted to mate with and conform with the curvature of the outer edge and exterior perimeter 16 of the top surface 12 of the spa 10. Referring to FIG. 7, an accessory device 20Δ is attached to the spa 10 by rectangular flanges 50 and 60 inserted into rectangular recesses 17'. Flange 50 has a pair of parallel side edges 52 and 54. Flange 60 has a pair of parallel side edges 62 and 64. As is clearly shown in FIG. 7, flanges 50 and 60 each extend radially inward toward the center of the spa 10 from the curved inner surface 24. Because of this arrangement, edges 52 and 54 of flange 50 are not parallel with edges 62 and 64 of flange 60 and the edge 54 of flange 50 and the edge 62 of flange 60 prevent the accessory device 20" from moving outwardly in the direction of arrow "A" away from the perimeter 16. Accessory device 20' in FIG. 7 is attached to spa 10 by flange 30'. Accessory device 20' is prevented from moving outwardly away from the perimeter by the projection 18 received by opening 32'. In the case of both accessory tray 20" and accessory tray 20', said at least one flange portion (40 and 50 in the case of accessory tray 20" and 30 in the case of accessory tray 20') prevents outward movement of said accessory device away from said perimeter 16. Lower surface 17"' of accessory 20" and lower surface 17 of accessory device 20' prevents the accessory devices 20" and 20', respectively (see FIGS. 6, 8 and 9), from moving downwardly in the direction of arrow "B". The lower surface 17"' and recess 17" as shown in FIG. 8 correspond to similar components, namely lower surface 17' and recess 17 as shown in FIG. 6. In the embodiment of FIG. 8, however, recess 17" has no projection member which corresponds to projection member 18 in FIG. 6. Accessory device 20" has a pair of support portions 34 extending downwardly from said upper surface portion 22 and having an inner wall 36 and an outer wall 38, said inner wall 36 adapted to rest upon and be supported by a side wall 40 of said spa when positioned thereon. This inner wall 36 prevents a lower portion of the accessory device from moving in the direction of arrow "C". The inner perimeter edge 24 of the upper surface prevents an upper portion of said accessory device 20" from moving in the direction of arrow "C". Accessory device 20' works in the same manner but with only one support portion 34".

Figure 4:
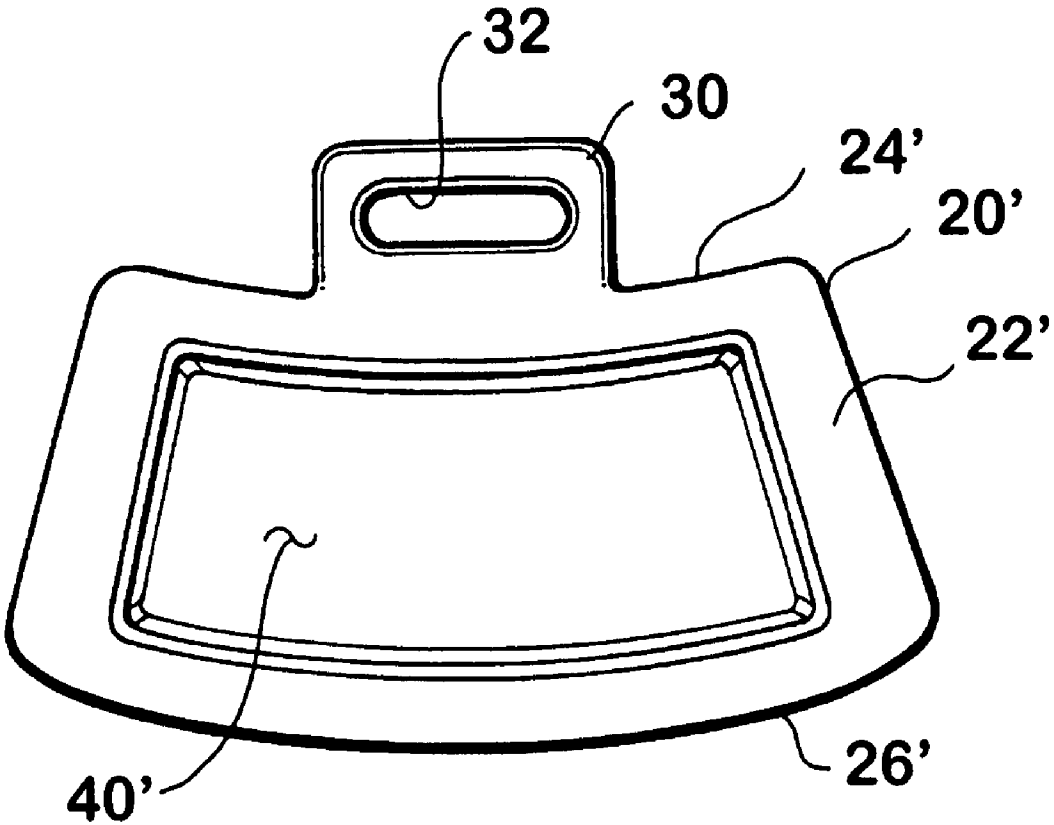
FIG. 4 is a top view of an accessory device in the form of an ice bucket.
Figure 5:
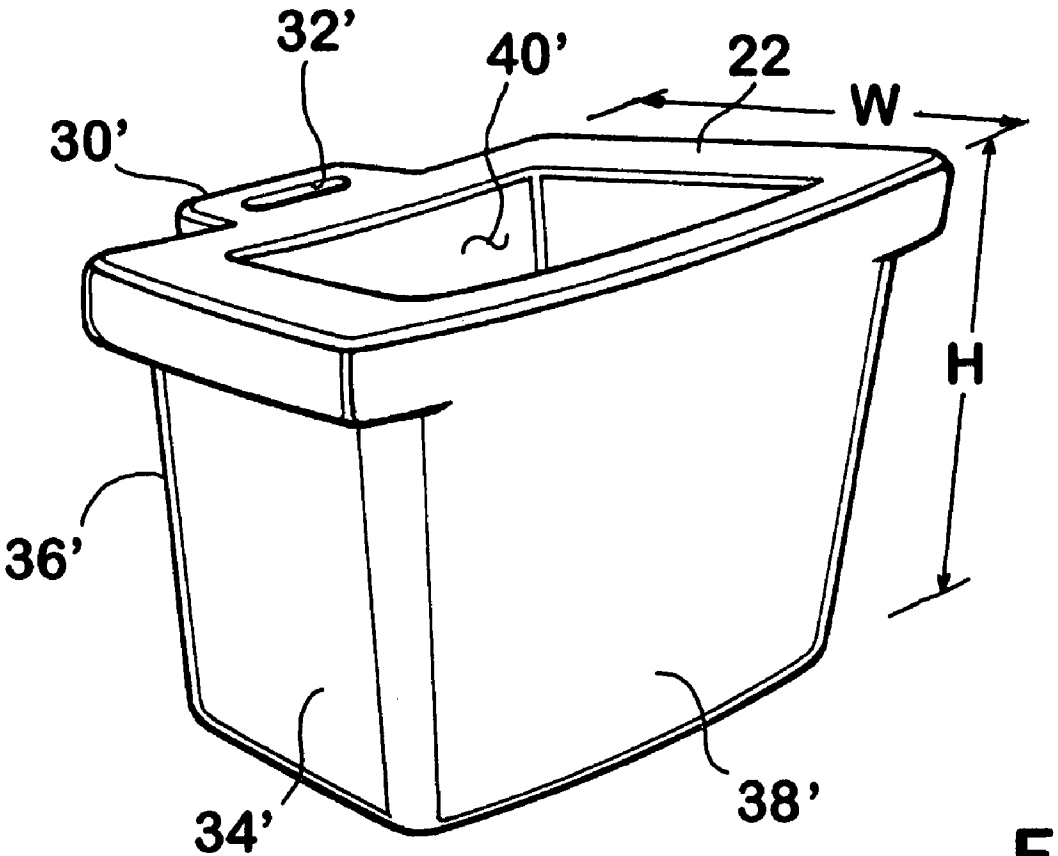
FIG. 5 is a perspective view of the accessory device of FIG. 4.

Referring to FIGS. 4 and 5, an accessory device 20' is shown. The part numbers on FIGS. 4 and 5 correspond to similarly numbered component numbers in FIGS. 2 and 3 but have a prime symbol added thereto. The only additional feature of FIGS. 4 and 5 is that a cavity 40' is provided in the upper surface 22' of the accessory device 20' thereby forming a bucket into which beverages and ice may be placed. As best shown in FIG. 5, the accessory device has relatively thick walls which enclose a space of air thereby making the ice bucket well insulated. As shown in FIG. 5, preferably the height H of the accessory device is approximately the same distance as the width W. This ratio provides a very stable support for the accessory device.

Turning to FIG. 6, the upper surface 12 of a spa 10 is shown. At the perimeter 16 of the spa, a rectangular recess 17 is formed into the upper surface 12. A projection 18 extends upwardly in a center portion of the recess 17. It will be obvious to the reader that the recess 17 is adapted to receive a flange 30 and the opening 32 in the flange is adapted to receive the projection 18. With this arrangement, the upper surface 22 is co-planer with the upper surface 12.

It will be apparent that in order for the flange to be mounted on the spa as shown in FIG. 6, that modifications to the design of the upper surface 12 of the spa 10 must be made at the time it is manufactured. It is also possible, although not preferred, to simply provide a projection member 18 directly on the upper surface 12 of an existing spa to allow for a removable attachment of a flange member 30. With this arrangement, however, the upper surface 22 will be at an elevation slightly higher than the top surface 12. Further, with this arrangement, it will be necessary to glue or otherwise attach projection members 18 directly to top surface 12.

The accessory devices of the present invention are preferably formed of plastic and can be easily removed or reattached from the spa. This allows for the easy transport of beverages or other objects to and from the spa allowing persons in the spa to have access to such items.

The invention having been disclosed in connection with the foregoing variations and examples, additional variations will now be apparent to persons skilled in the art. The invention is not intended to be limited to the variations specifically mentioned, and accordingly, reference should be made to the appended claims rather than the foregoing discussion of preferred examples, to assess the scope of the invention in which exclusive rights are claimed.

I claim:

1. An accessory device for a spa comprising:

a spa having a top surface, said top surface having an exterior perimeter and at least one recess therein, said at least one recess formed of a particular shape and formed into said perimeter whereby said at least one recess creates a notch in said perimeter, said spa also having a side wall;

said accessory device formed of a plastic material, said accessory device having an upper surface portion having an inner edge and outer edge, said upper surface portion adapted to extend outwardly from said exterior perimeter of said top surface of a said spa when positioned thereon with said inner edge juxtaposed to said perimeter, said accessory device having at least one flange portion extended inwardly from said inner edge of said upper surface, said at least one flange portion having a shape matching said particular shape of said at least one recess and whereby said at least one flange portion prevents outward movement of said accessory device away from said perimeter, said flange portion adapted to be removably attached to the top surface of the spa whereby said flange fits securely and completely into said at least one recess and rests on a lower surface of said recess and holds said accessory tray securely onto said spa in a manner allowing easy placement and removal thereof and whereby said upper surface of the accessory device is coplanar with the top surface of the spa; and at least one support portion extending downwardly from said upper surface portion and having an inner wall and an outer wall, said inner wall adapted to rest upon and be supported by a side wall of said spa when positioned thereon.

2. An accessory device according to claim 1 wherein said upper surface portion functions as a tray for holding objects in a location accessible to persons in the spa.

3. An accessory device according to claim 1 wherein said upper surface portion has a cavity formed therein, said cavity functioning as a bucket for holding objects in a location accessible to persons in the spa.

4. An accessory device according to claim 1 wherein said inner edge of said upper surface is curved.

5. An accessory device according to claim 4 wherein said inner edge of said upper surface is curved along an arcuate path and is adapted to mate with and conform with the curvature of the exterior perimeter of the top surface of the spa.

6. An accessory device according to claim 1 wherein said outer edge of said upper surface is curved.

7. An accessory device according to claim 1 wherein said at least one flange portion and said recess are each generally rectangular in shape.

8. An accessory device according to claim 1 wherein said at least one flange portion has an opening therein which is generally rectangular in shape.

9. An accessory device according to claim 1 further comprising a projection member which is generally rectangular in shape.

10. An accessory device according to claim 1 wherein said at least one recess further comprises a pair of spaced apart recesses and wherein a pair of spaced apart flange members are provided on said accessory device, said pair of flange members adapted to be received by said pair of spaced apart recesses on said top surface of said spa.

11. An accessory device according to claim 1 wherein a pair of spaced apart support portions are provided.

12. An accessory device for a spa comprising:

a spa having a top surface, said top surface having an exterior perimeter and at least one recess therein, said at least one recess formed of a particular shape and formed into said perimeter whereby said at least one recess creates a notch in said perimeter, said spa also having side wall;

said accessory device formed of a plastic material, said accessory device having an upper surface portion having an inner edge and outer edge, said upper surface portion adapted to extend outwardly from said exterior perimeter of said top surface of said spa when positioned thereon with said inner edge juxtaposed to said perimeter, said accessory device having at least one flange portion extended inwardly from said inner edge of said upper surface, said at least one flange portion having a shape matching said particular shape of said at least one recess and whereby said at least one flange portion prevents outward movement of said accessory device away from said perimeter, said flange portion adapted to be removably attached to the top surface of the spa whereby said flange fits securely and completely into said at least one recess and rests on a lower surface of said recess and holds said accessory tray securely onto said spa in a manner allowing easy placement and removal thereof and whereby said upper surface of the accessory device is coplanar with the top surface of the spa; and at least one support portion extending downwardly from said upper surface portion and having an inner wall and an outer wall, said inner wall adapted to rest upon and be supported by a side wall of said spa when positioned thereon wherein said flange portion has an opening therein adapted to receive a projection member extending upward from said top surface of said spa.

13. An accessory device for a spa comprising:

a spa having a top surface, said top surface having an exterior perimeter and a recess therein, said recess formed of a particular shape and formed into said perimeter whereby said recess creates a notch in said perimeter, said spa also having a side wall;

said accessory device formed of a plastic material having thick walls and enclosing a space of air, said accessory device having an upper surface portion having an inner edge and outer edge, said upper surface portion adapted to extend outwardly from said exterior perimeter of said top surface of said spa when positioned thereon, said accessory device having at least one flange portion extended inwardly along only a portion of said inner edge of said upper surface, said at least one flange portion having a shape matching said particular shape of said recess, said flange portion adapted to be removably attached to the top surface of the spa whereby said flange fits securely and completely into said recess and holds said accessory tray securely onto said spa in a manner allowing easy placement and removal thereof and whereby said upper surface of the accessory device is coplanar with the top surface of the spa, wherein said at least one flange portion is received in a recess in the top surface of the spa when positioned thereon and said flange portion has an opening therein which receives a projection member extending upward from a center portion of said recess.

14. An accessory device according to claim 3 wherein said accessory device formed of a plastic material and encloses a space of air.

* * * * *